US009254410B1

(12) United States Patent
Mirza

(10) Patent No.: US 9,254,410 B1
(45) Date of Patent: Feb. 9, 2016

(54) MULTI-GRIP EXERCISE BAR

(71) Applicant: Abdullah Ayman Abd Alrasoul Mirza, Al Andalus (KW)

(72) Inventor: Abdullah Ayman Abd Alrasoul Mirza, Al Andalus (KW)

( * ) Notice: Subject to any disclaimer, the term of this patent is extended or adjusted under 35 U.S.C. 154(b) by 0 days.

(21) Appl. No.: 14/925,556

(22) Filed: Oct. 28, 2015

(51) Int. Cl.

| | |
|---|---|
| ***A63B 21/072*** | (2006.01) |
| ***A63B 21/075*** | (2006.01) |
| ***A63B 71/00*** | (2006.01) |
| ***A63B 21/00*** | (2006.01) |
| ***A63B 23/12*** | (2006.01) |
| *A63B 21/06* | (2006.01) |

(52) U.S. Cl.
CPC ..... *A63B 21/4035* (2015.10); *A63B 21/0004* (2013.01); *A63B 23/12* (2013.01); *A63B 21/06* (2013.01); *A63B 21/072* (2013.01); *A63B 21/0724* (2013.01)

(58) Field of Classification Search
CPC ..... A63B 1/00; A63B 21/00; A63B 21/0004; A63B 21/00043; A63B 21/06; A63B 21/072; A63B 21/0722; A63B 21/0724; A63B 21/0726; A63B 21/0728; A63B 21/075; A63B 21/078; A63B 21/0783; A63B 21/4033; A63B 21/4035; A63B 21/4043
USPC ..... 482/106–107, 139
See application file for complete search history.

(56) References Cited

U.S. PATENT DOCUMENTS

| | | | | | |
|---|---|---|---|---|---|
| 2,508,567 | A | * | 5/1950 | Dymeck | A63B 21/0724 482/106 |
| 4,274,628 | A | * | 6/1981 | Hoagland | A63B 21/0724 482/106 |
| D262,814 | S | | 1/1982 | Lambert, Jr. et al. | |
| 4,531,729 | A | * | 7/1985 | Wrinkle | A63B 21/0004 482/106 |
| D290,485 | S | | 6/1987 | Suponitsky | |
| D320,636 | S | | 10/1991 | Eckler | |
| 5,076,578 | A | * | 12/1991 | Askonen | A63B 23/12 482/139 |
| D324,894 | S | | 3/1992 | Porcello | |
| 6,010,439 | A | * | 1/2000 | Bullard, Jr. | A63B 21/4029 482/106 |

(Continued)

FOREIGN PATENT DOCUMENTS

CN 203370222 U 1/2014

*Primary Examiner* — Oren Ginsberg
*Assistant Examiner* — Joshua Lee
(74) *Attorney, Agent, or Firm* — Richard C. Litman

(57) ABSTRACT

The multi-grip exercise bar includes an elongate cylindrical shaft having end sleeves at opposite ends for selective mounting of weights. The cylindrical shaft has a pair of intermediate, symmetrically disposed, offset, coplanar grip portions formed by trapezoidal bends in the shaft, defining a main longitudinal axis and an offset longitudinal axis. Eight knurled grips are formed on the shaft. A pair of handles extend from a central section of the shaft parallel to each other, providing another pair of grips. Two outer sections of the shaft along the main axis provide a wide pair of grips for straight lifts, and two sections along the offset axis provide a narrow pair of grips for straight lifts. The four oblique legs of the offset portions provide wide and narrow pairs of grips for curl lifts, with either internal or external rotation of the wrists. The two handles provide grips for triceps lifts.

14 Claims, 5 Drawing Sheets

(56) References Cited

U.S. PATENT DOCUMENTS 7,244,220 B2 7/2007 Carney
7,967,737 B2 * 6/2011 Watson ..... A63B 5/20 482/139
8,556,781 B1 * 10/2013 Fitzpatrick ..... A63B 21/0724 482/106
8,574,136 B1 * 11/2013 Burstrom ..... A63B 69/0057 482/108
8,951,170 B1 * 2/2015 Tayo ..... A63B 21/0724 482/107
2003/0130096 A1 * 7/2003 LaCroce ..... A63B 21/0724 482/106
2005/0227838 A1 * 10/2005 Friesen ..... A63B 43/02 482/148
2013/0196830 A1 8/2013 Pfitzer
2014/0221173 A1 * 8/2014 Crabtree ..... A63B 21/0724 482/106
2014/0287886 A1 * 9/2014 Patti ..... A63B 71/0054 482/93

* cited by examiner

MULTI-GRIP EXERCISE BAR

BACKGROUND OF THE INVENTION

1. Field of the Invention

The present invention relates to exercise devices, and particularly to a multi-grip exercise bar that provides a plurality of gripping positions to facilitate performance of a plurality of various exercises.

2. Description of the Related Art

Exercise provides many benefits to those who regularly participate in various physical activities. Besides maintaining and increasing physical health and strength, exercise has been known to increase longevity and general well-being. Many exercises can be performed without specialized equipment, but other exercises do, especially for strength training, which usually requires weights or other forms of resistance. Much of the equipment is furnished through participation in public and private gyms or from purchasing exercise equipment. However, both prospects can be relatively expensive in terms of gym fees, travel time, and storage space for accumulated exercise devices. Although many exercise devices are available, there is still a need for some sort of exercise device or equipment that enables performance of a wide range of exercises without requiring much storage space.

Weightlifting exercises typically require different bars to support the weights. Straight lifts are usually performed using a linear barbell. The barbell usually has rotating sleeves at the ends of the bar, on which weight plates are mounted and secured by collars. The sleeves may be rotatably mounted using bushings or bearings, usually roller bearings. A second type of bar is a curl bar or curling bar, which is similar to the straight bar, but has V-shaped bends in the bar so that the bar can be gripped with the wrists at an angle to the bar to perform curls. A third type of barbell is a triceps bar, which has a pair of handles extending from opposite sides of a cage. The different bars are designed to make different types of lifts targeting different muscle groups easier to perform, reducing torque and stress on the wrists to prevent injury. It is expensive for the small gym or home-based weightlifting enthusiast to equip their facility with the different types of bar for supporting weights. Thus, a multi-grip exercise bar solving the aforementioned problems is desired.

SUMMARY OF THE INVENTION

The multi-grip exercise bar includes an elongate cylindrical shaft having end sleeves at opposite ends for selective mounting of weights. The cylindrical shaft has a pair of intermediate, symmetrically disposed, offset, coplanar grip portions formed by trapezoidal bends in the shaft, defining a main longitudinal axis and an offset longitudinal axis. Eight knurled grips are formed on the shaft. A pair of handles extend, preferably orthogonally, from a central section of the shaft parallel to each other, providing another pair of grips. Two outer sections of the shaft along the main axis provide a wide pair of grips for straight lifts, and two sections along the offset axis provide a narrow pair of grips for straight lifts. The four oblique legs of the offset portions provide wide and narrow pairs of grips for curl lifts, with either internal or external rotation of the wrists. The two handles provide grips for triceps lifts.

The multi-grip exercise bar is intended to provide a single barbell that can be used to perform different types of weightlifting exercises targeting different muscle groups that would otherwise require the use of several different bars for supporting the weight plates.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The multi-grip exercise bar is intended to provide a single barbell that can be used to perform different types of weightlifting exercises targeting different muscle groups that would otherwise require the use of several different bars for supporting the weight plates.

The multi-grip exercise bar includes an elongate cylindrical shaft having end sleeves at opposite ends for selective mounting of weights. The cylindrical shaft has a pair of intermediate, symmetrically disposed, offset, coplanar grip portions formed by trapezoidal bends in the shaft, defining a main longitudinal axis and an offset longitudinal axis. Eight knurled grips are formed on the shaft. A pair of handles extend, preferably orthogonally, from a central section of the shaft parallel to each other, providing another pair of grips. Two outer sections of the shaft along the main axis provide a wide pair of grips for straight lifts, and two sections along the offset axis provide a narrow pair of grips for straight lifts. The four oblique legs of the offset portions provide wide and narrow pairs of grips for curl lifts, with either internal or external rotation of the wrists. The two handles provide grips for triceps lifts.

Figure 1:
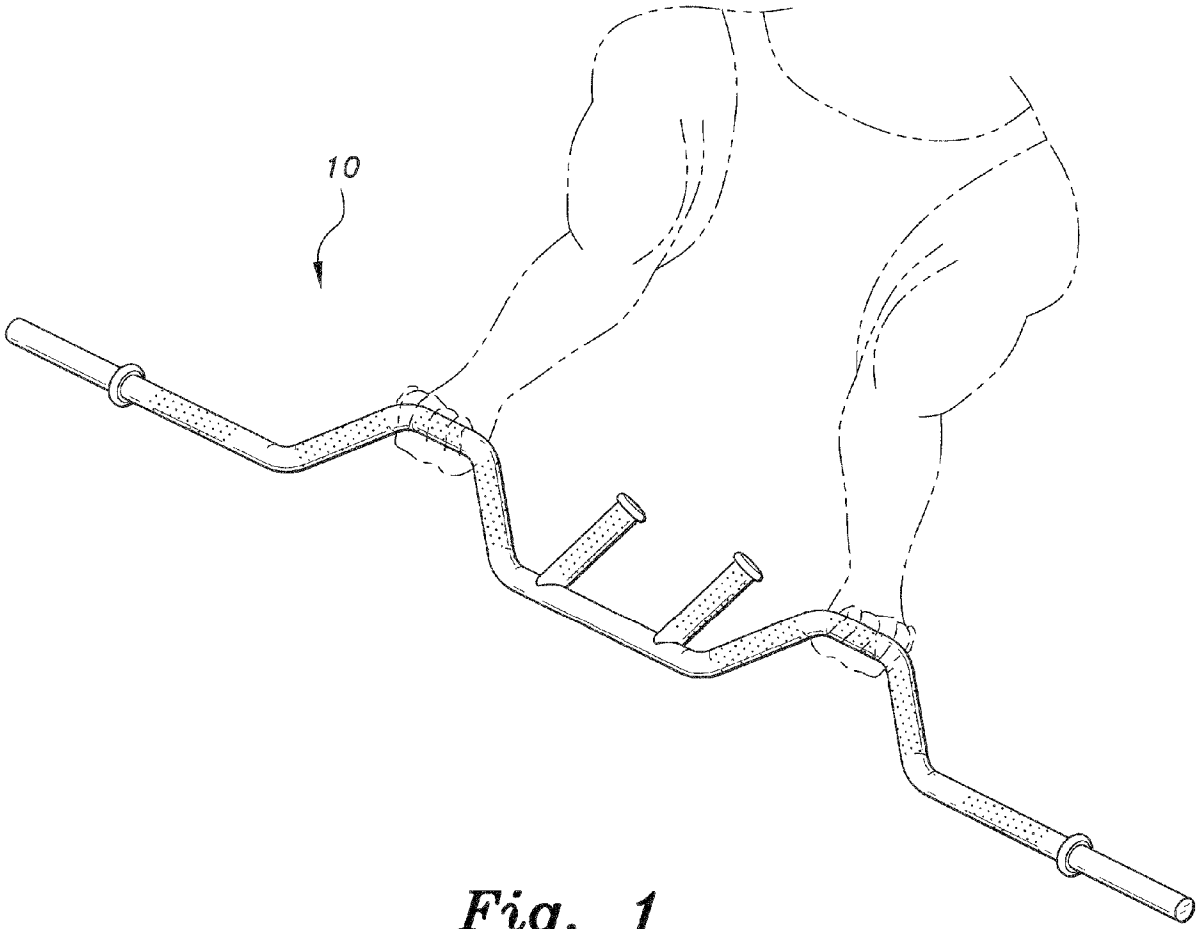
FIG. 1 is an environmental, perspective view of a first embodiment of a multi-grip exercise bar according to the present invention.
Figure 2:
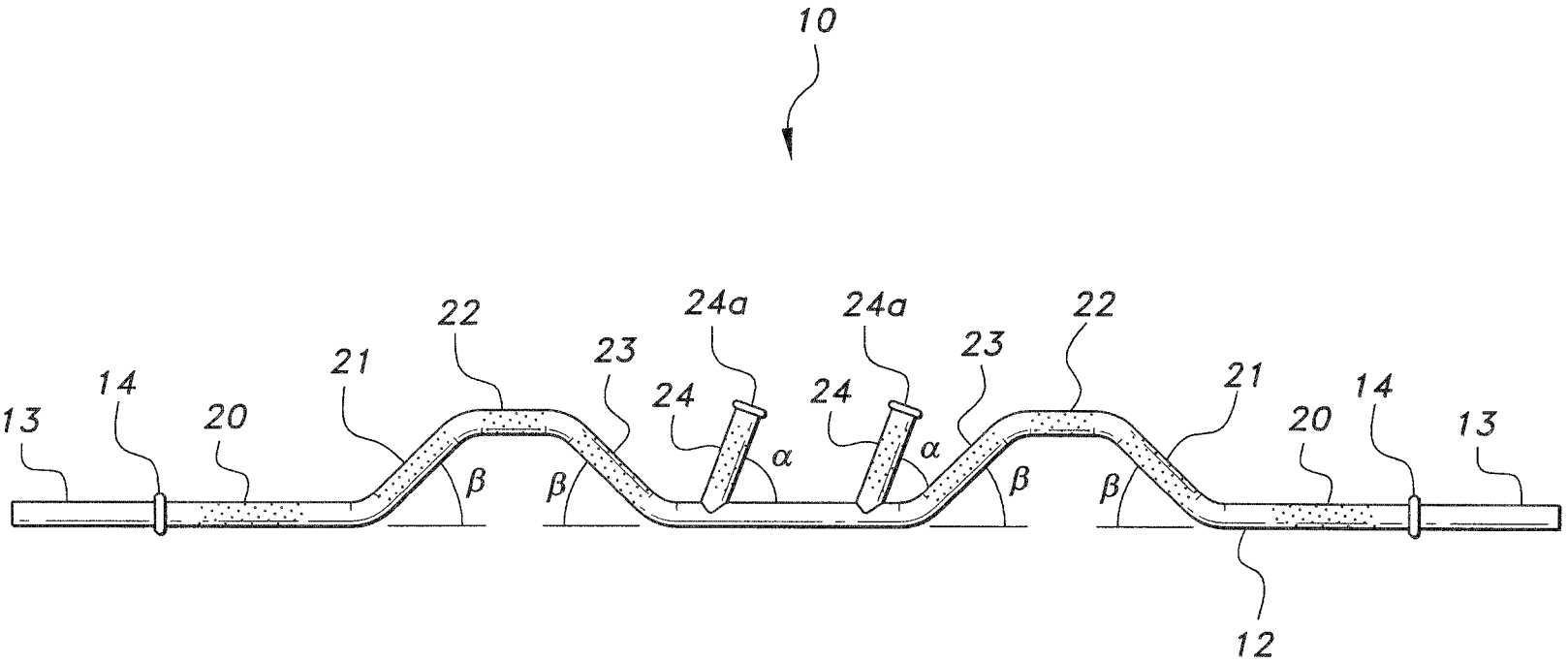
FIG. 2 is a plan view of the multi-grip exercise bar of FIG. 1.

The multi-grip exercise bar, a first embodiment of which is generally referred to by the reference number 10 in the Figures, provides many different gripping positions to facilitate performance of a wide range of exercises. As best shown in FIGS. 1 and 2, the multi-grip exercise bar 10 includes an elongate shaft 12 having weight sleeves 13 at opposite ends. The sleeves 13 enable weights to be selectively and slidably mounted thereon. Hence, the sleeves 13 are preferably smooth to allow easy sliding mounting of the weights. A stop 14 is provided at an inner end of each sleeve 13, the inner end being the portion towards the center of the shaft 12. The sleeves 13 can be constructed as integral sections of the shaft 12 or a freely rotating member on the shaft 12. Similarly, the stop 14 can be an integral member of the shaft 12 or of the respective sleeve 13. Each stop 14 is preferably an annular disk that forms an abutment for the user to push the mounted weight(s) toward, but prevents the weight plates from sliding towards the center of the shaft 12. The shaft 12 is preferably made from steel or stainless steel. The length and diameter of the shaft 12 and sleeves may comply with either standard barbell requirements or Olympic barbell requirements.

Figure 5:
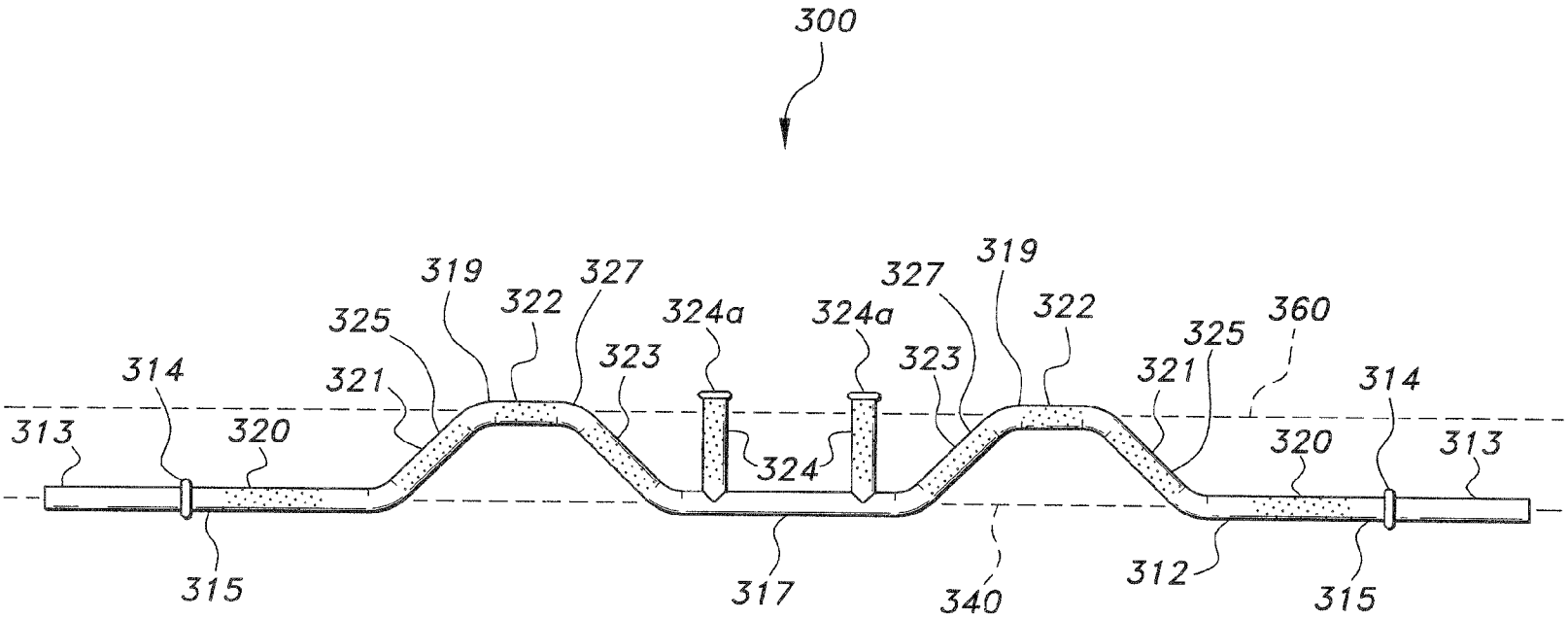
FIG. 5 is a plan view of a fourth embodiment of a multi-grip exercise bar according to the present invention.

As best shown in FIG. 5, in the multi-grip exercise bar 300, the shaft (designated 312 in FIG. 5) has two trapezoidal bends, preferably isosceles trapezoidal bends (i.e., a symmetrical trapezoid having parallel bases and oblique legs that are equal in length) that define a main longitudinal axis 340 and an offset longitudinal axis 360. The shaft 312 has two outer sections 315 and a central section 317 that are coaxial along the main axis 340. The shaft 312 also has two offset sections 319 that are coaxial along the offset axis 360, which is parallel to the main axis 340. The shaft 312 also has four oblique legs 325, 327 connecting the offset sections 319 with the central section 317 and the outer sections 315. A pair of handles 324 extend parallel to each other from the central section 317. The handles 324 are constructed from relatively short bar lengths or stubs of the same material as the shaft 312. In the embodiment of FIG. 5, the handles 324 extend orthogonally from the central section 317, while in the embodiment of FIGS. 1 and 2, the handles 24 extend obliquely from the central section (the angular disposition being represented by the angle $\alpha$ in FIG. 2), which is the only difference between the two embodiments.

The shaft 12, 312 includes a plurality of pairs of grips or grip sections to permit the user to perform a variety of different exercises. Each grip or grip section preferably comprises a knurled surface to enhance frictional grasping of the shaft 12, 312. Instead of a knurled surface, each grip may comprise a layer of material having a high coefficient of friction, such as rubber, elastomer, elastic foam, or the like. Since the grips are usually used in pairs, it is to be understood that the following description refers to corresponding specific pairs in mirror disposition along the length of the shaft 12, 312.

Each outer section 315 defines a grip 320 (corresponding to grips 20 in FIG. 2) that is useful for performing a straight lift with the arms separated widely. Each offset section 319 defines a grip 322 (corresponding to grips 22 in FIG. 2) that is useful for performing a straight lift with the arms separated narrowly or more closely than permitted by the grips 320, 20. The obliquely extending legs of the trapezoidal offset include an outer pair of legs 325 defining wide grips 321 (corresponding to grips 21 in FIG. 2) and an inner pair of legs 327 defining narrow grips 323 (corresponding to grips 23 in FIG. 2) that may be used for curling lifts with either internal or external rotation of the wrists and hands, the wide grips 321, 21 being used with the arms spread more widely and the narrow grips 323, 23 being used with the arms closer together. Finally, the handles 324 (corresponding to handles 24 in FIG. 2) have grips defined thereon to assist gripping the handles 324, 24 for parallel holding grips.

Figure 3:
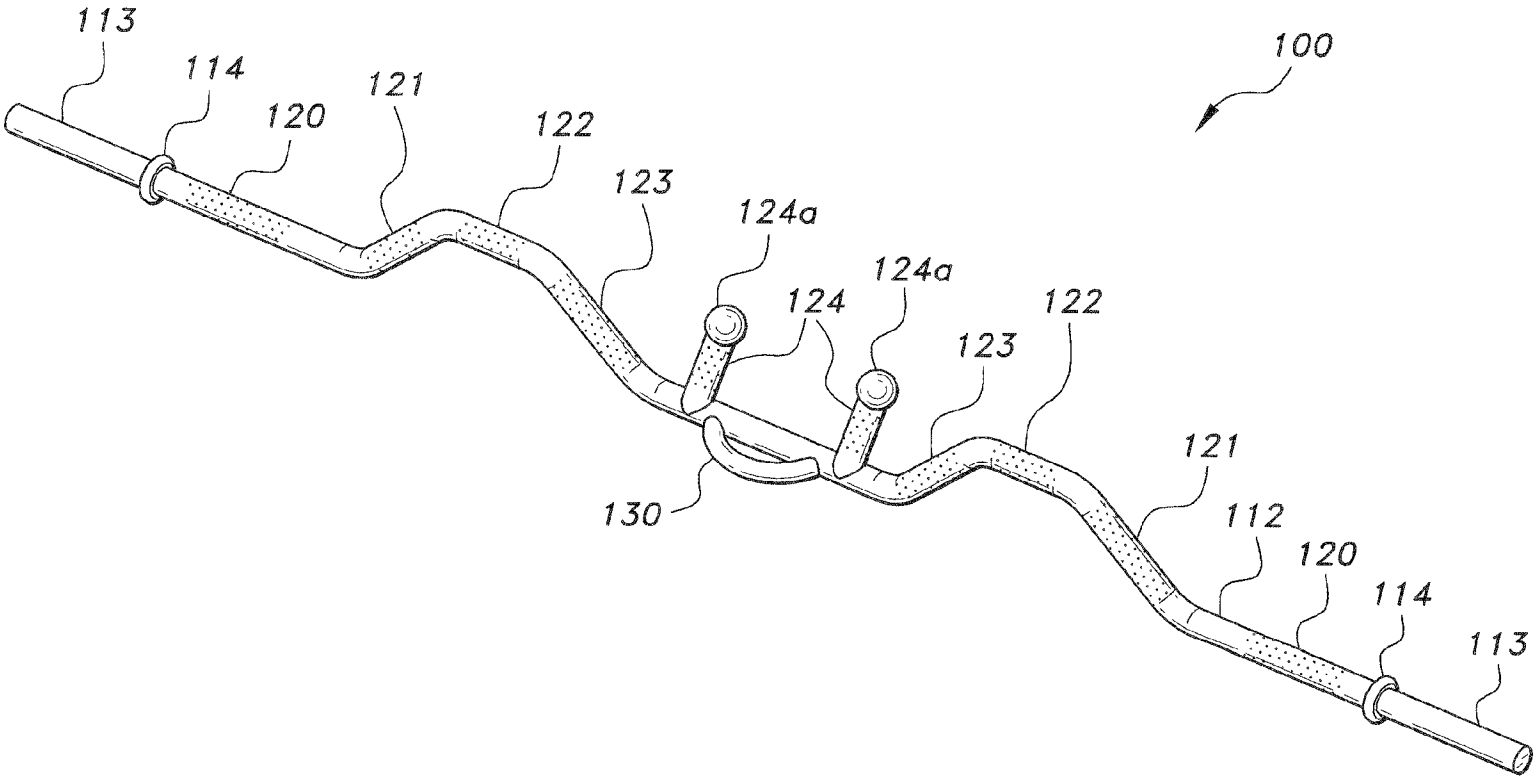
FIG. 3 is a perspective of a second embodiment of a multi-grip exercise bar according to the present invention.
Figure 4:
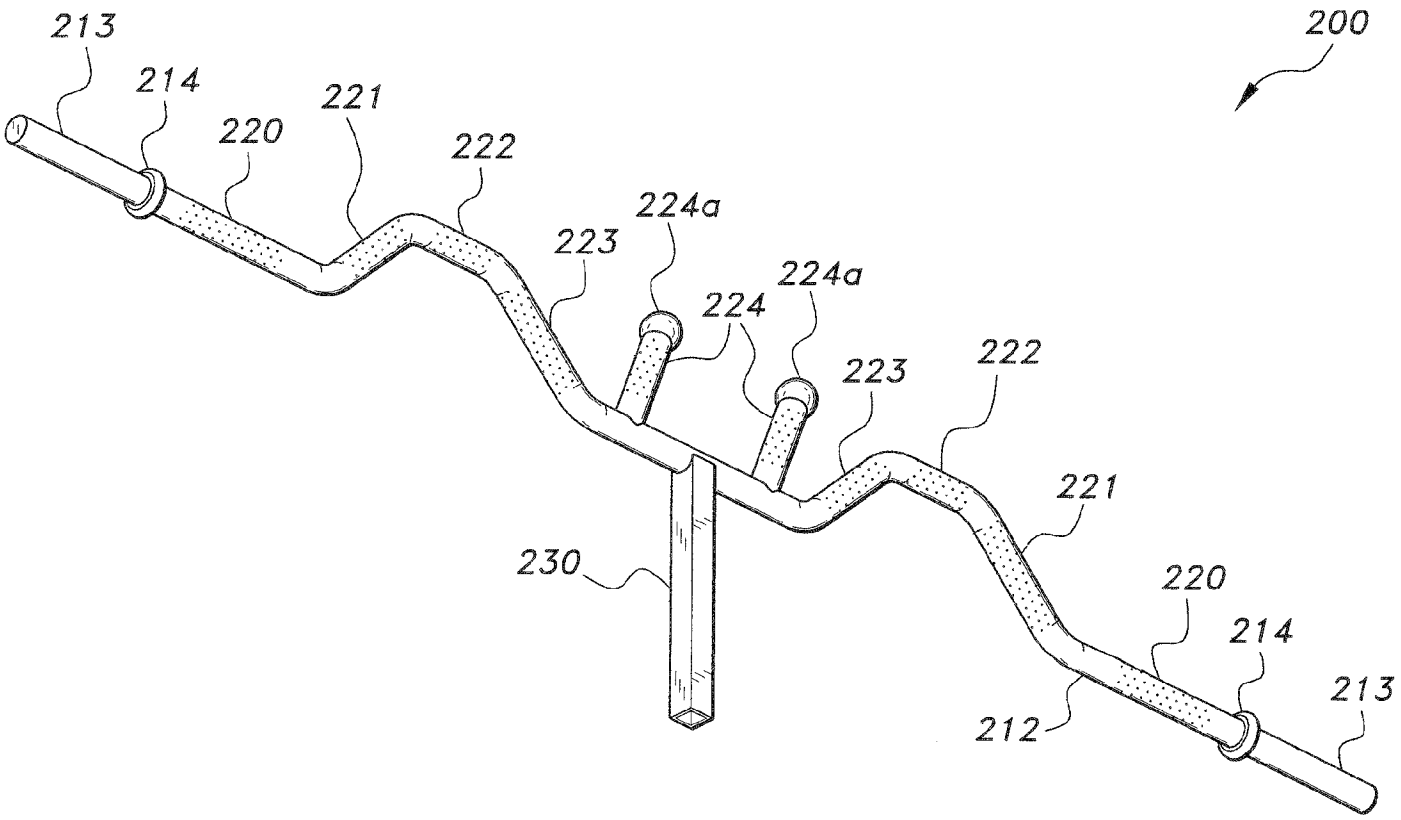
FIG. 4 is a perspective view of a third embodiment of a multi-grip exercise bar according to the present invention.

The distal end of each of the handles 24, 324 can include a grip stop 24*a*, 324*a* to provide an abutment that assists in preventing easy slippage of the user's grip thereon during exercise. The grip stop 24*a*, 324*a* may be of any desired configuration, such as the relatively flat disc 24*a* shown in FIGS. 1, 2, and 5, or a ball, as shown in FIGS. 3 and 4, so long as they present an enlarged member at the distal end of the handles 24, 324 as an abutment.

The trapezoidal offset sections are coplanar and preferably isosceles trapezoidal so that the outer leg 325 is equal in length to the inner leg 327, the legs 325, 327 and corresponding grips 321, 21 and 323, 23 extending at equal but mirror opposite angles 13. The isosceles trapezoidal bends are preferably congruent on opposite sides of the central section 317 so that the offsets are symmetrical, and also entail that the outer portion of each offset is a symmetrical mirror image of the inner portion.

The angular dispositions of the grips 20, 21, 22, 23, 24 provides the user with various positions for holding the shaft 12 and perform corresponding exercises therewith. Moreover, each grip 20, 21, 22, 23, 24 can be held in either pronated or supinated positions of the hands. For example, the outer grips 20, when held in the supinated position, allows the user to perform basic curls for strength training the biceps, with emphasis on the lateral areas of the biceps. The relatively large separation of the outer grips 20 is suitable for performing bent-over rows, lifts, and other similar exercises. The grips 21, 22, and 23 target other areas of the muscle when performing curls. The first grips 20, when held in the pronated position, allows the user to perform reverse curls, strengthening the forearms, brachialis, and brachioradialis; triceps exercises; deadlifts; and latissimus lifts for the latissimus dorsi of the back.

The use of the grips 20, 21, 22, 23, 24 in any predetermined order provides a complete exercise of the major muscle groups in the upper body, such as the biceps, triceps, deltoids, pectorals, and the back. Moreover, the multi-grip exercise bar 10 enables the user to perform a plurality of exercises with one piece of exercise equipment instead of a plurality, where each of the plurality is configured for one specific exercise or set of exercises. The multi-grip exercise bar 10 also allows the user to be more efficient during an exercise session by minimizing transition time between one exercise to another, thereby facilitating intense training sessions according to the physical capabilities of the user.

Additional embodiments of the multi-grip exercise bar 10 are shown in FIGS. 3-4. The multi-grip exercise bar 100, 200, are all similar to the multi-grip exercise bar 10 and perform in substantially the same manner. As such, the following description will be directed to the differences for brevity. Similar reference numbers in the respective numerical series have been used to designate similar features.

The multi-grip exercise bar 100 in FIG. 3 includes a mounting loop 130 extending from the middle section of the shaft 112. The mounting loop 130 preferably extends perpendicular to the handles 124. It is also contemplated that the mounting loop 130 can extend at a variety of other angles. The mounting loop 130 enables the multi-grip exercise bar 100 to be hooked or suspended on a pulley exercise system or any hanging structure, which expands the versatility of the multi-grip exercise bar 100. When mounted to a pulley system, the multi-grip exercise bar 100 can be used as a pull bar for exercising the back, triceps extensions, rows, or many other exercises that can be performed on a pulley with variable weight resistance.

The multi-grip exercise bar 200 in FIG. 4 is similar to the multi-grip exercise bar 100, but includes an elongate mounting bar or beam 230. The mounting beam 230 preferably extends in an opposite orientation or away from the handles 224. Moreover, the mounting beam 230 is preferably constructed from a square or rectangular tube or pipe serving as a male member that can be inserted into a corresponding socket or receiving bar. When mounted in this manner, the handles 224 extend horizontally to allow the user to perform various types of pull-ups, dips, and the like. The square or rectangular shape is preferred to provide a stable connection when mounted, stable in the sense that the multi-grip exercise bar 200 will not rotate in the mounting.

It is to be understood that the present invention is not limited to the embodiments described above, but encompasses any and all embodiments within the scope of the following claims.

I claim:

1. A multi-grip exercise bar, comprising:

an elongate cylindrical shaft having opposing ends, the shaft having a pair of intermediate, symmetrically disposed, offset, coplanar grip portions formed by trapezoidal bends in the shaft, defining a main longitudinal axis and a parallel offset longitudinal axis, the shaft having:

a pair of outer sections and a central section coaxially aligned on the main longitudinal axis;

a pair of offset sections coaxially aligned on the offset longitudinal axis; and four obliquely angled leg sections connecting the offset sections with the outer sections and the central section, each of the outer sections, the offset sections, and the leg sections having a grip disposed thereon;

a pair of sleeves adapted for securing weight plates thereto disposed at the opposing ends of the shaft, respectively; and a pair of handles extending from the central section of the shaft parallel to each other and coplanar with the grip sections formed by the trapezoidal bends in the shaft, each of the handles having a grip disposed thereon; wherein each said handle comprises a short stub bar having a free end and a grip stop disposed at the free end.

2. The multi-grip exercise bar according to claim 1, wherein each of said offset grip portions includes two of the obliquely angled leg sections, one of the two being an outer leg disposed nearer the corresponding outer section, the other of the two being an inner leg disposed nearer the central section of said shaft, the corresponding offset section extending between the inner leg and the outer leg.

3. The multi-grip exercise bar according to claim 2, wherein said trapezoidal bends comprise isosceles trapezoidal bends, said outer leg and said inner leg being equal in length.

4. The multi-grip exercise bar according to claim 1, wherein each said grip comprises a knurled surface.

5. The multi-grip exercise bar according to claim 1, wherein said handles extend from the central section at an oblique angle.

6. The multi-grip exercise bar according to claim 1, wherein said handles extend orthogonally from the central section of said shaft.

7. The multi-grip exercise bar according to claim 1, wherein said grip stop comprises a flat disc.

8. The multi-grip exercise bar according to claim 1, wherein said grip stop comprises a ball.

9. The multi-grip exercise bar according to claim 1, wherein said sleeves are removably attached to the ends of said shaft.

10. The multi-grip exercise bar according to claim 1, wherein said sleeves are rotatably attached to the ends of said shaft.

11. The multi-grip exercise bar according to claim 1, further comprising a mounting loop extending from said central section for suspending said shaft.

12. The multi-grip exercise bar according to claim 11, wherein said mounting loop extends perpendicularly with respect to said pair of handles.

13. The multi-grip exercise bar according to claim 1, further comprising an elongate mounting bar extending from said central section, said mounting bar extending in a direction away from said parallel handles.

14. The multi-grip exercise bar according to claim 13, wherein said mounting bar comprises an elongate square tube.

* * * * *